US009324338B2

(12) United States Patent
Le Roux et al.

(10) Patent No.: US 9,324,338 B2
(45) Date of Patent: Apr. 26, 2016

(54) DENOISING NOISY SPEECH SIGNALS USING PROBABILISTIC MODEL

(71) Applicant: Mitsubishi Electric Research Laboratories, Inc., Cambridge, MA (US)

(72) Inventors: Jonathan Le Roux, Somerville, MA (US); John R. Hershey, Winchester, MA (US); Umut Simsekli, Istanbul (TR)

(73) Assignee: Mitsubishi Electric Research Laboratories, Inc., Cambridge, MA (US)

( * ) Notice: Subject to any disclaimer, the term of this patent is extended or adjusted under 35 U.S.C. 154(b) by 138 days.

(21) Appl. No.: 14/225,870

(22) Filed: Mar. 26, 2014

(65) Prior Publication Data

US 2015/0112670 A1 Apr. 23, 2015

Related U.S. Application Data

(60) Provisional application No. 61/894,180, filed on Oct. 22, 2013.

(51) Int. Cl.
*G10L 21/0208* (2013.01)

(52) U.S. Cl.
CPC ... *G10L 21/0208* (2013.01); *G10L 2021/02087* (2013.01)

(58) Field of Classification Search
CPC ..... G10L 21/02; G10L 21/03
See application file for complete search history.

(56) References Cited

U.S. PATENT DOCUMENTS 8,015,003 B2 * 9/2011 Wilson ..... G10L 21/0208 704/226
8,280,739 B2 10/2012 Jiang et al.
2005/0091042 A1 * 4/2005 Acero ..... G10L 25/78 704/205
2009/0132245 A1 * 5/2009 Wilson ..... G10L 21/0272 704/226
2009/0265168 A1 * 10/2009 Kang ..... G10L 21/0208 704/226
2012/0143604 A1 * 6/2012 Singh ..... G10L 21/0208 704/226
2012/0215519 A1 * 8/2012 Park ..... G06F 17/289 704/2

FOREIGN PATENT DOCUMENTS

EP 1760696 A2 3/2007

OTHER PUBLICATIONS

Fevotte et al., "Non-negative dynamical system with application to speech and audio," 2013 IEEE International Conference on Acoustics, Speech and Signal Processing. May 1, 2013. pp. 3158-3162.

* cited by examiner

*Primary Examiner* — Douglas Godbold
(74) *Attorney, Agent, or Firm* — Gene Vinokur; Dirk Brinkman

(57) ABSTRACT

A method determines from an input noisy signal sequences of hidden variables including at least one sequence of hidden variables representing an excitation component of the clean speech signal, at least one sequence of hidden variables representing a filter component of the clean speech signal, and at least one sequence of hidden variables representing the noise signal. The sequences of hidden variables include hidden variables determined as a non-negative linear combination of non-negative basis functions. The determination uses the model of the clean speech signal that includes a non-negative source-filter dynamical system (NSFDS) constraining the hidden variables representing the excitation and the filter components to be statistically dependent over time. The method generates an output signal using a product of corresponding hidden variables representing the excitation and the filter components.

17 Claims, 9 Drawing Sheets

610

| 650 | 620 | 630 | 640 |
|---|---|---|---|
| | $a$ | $b$ | $c$ |
| $u_{kn}$ | $\sum_f \frac{w^r_{fk}}{v^r_{fn}} + \frac{\beta}{\prod_i b_{ki}^{[h^r_n = i]}}$ | $1-\alpha$ | $-u^2_{kn} \sum_f \frac{s_{fn}}{g_n v^e_{fn} \hat{s}^2_{fn}} w^r_{fk}$ |
| $g_n \ (n=1)$ | $(F+\phi)^2$ | $0$ | $-\left[\sum_f \frac{s_{fn}}{v^r_{fn} v^e_{fn}} + \psi g_{n+1}\right]^2$ |
| $g_n \ (1<n<N)$ | $\frac{\psi}{g_{n-1}}$ | $F+1$ | $-\left[\sum_f \frac{s_{fn}}{v^r_{fn} v^e_{fn}} + \psi \frac{g_n}{g_{n+1}}\right]$ |
| $g_n \ (n=N)$ | $\frac{\psi}{g_{n-1}}$ | $F+1-\phi$ | $-\left[\sum_f \frac{s_{fn}}{v^r_{fn} v^e_{fn}}\right]$ |

Fig. 6

DENOISING NOISY SPEECH SIGNALS USING PROBABILISTIC MODEL

RELATED APPLICATIONS

This application claims the priority under 35 U.S.C. §119 (e) from U.S. provisional application Ser. No. 61/894,180 filed on Oct. 22, 2013, which is incorporated herein by reference.

FIELD OF THE INVENTION

This invention relates generally to processing acoustic signals, and more particularly to removing additive noise from acoustic signals such as speech signals.

BACKGROUND OF THE INVENTION

Removing additive noise from acoustic signals, such as speech signals has a number of applications in telephony, audio voice recording, and electronic voice communication. Noise is pervasive in urban environments, factories, airplanes, vehicles, and the like.

It is particularly difficult to denoise time-varying noise, which more accurately reflects real noise in the environment. Typically, non-stationary noise cancellation cannot be achieved by suppression techniques that use a static noise model. Conventional approaches such as spectral subtraction and Wiener filtering typically use static or slowly-varying noise estimates, and therefore are restricted to stationary or quasi-stationary noise.

Speech includes harmonic and non-harmonic sounds. The harmonic sounds can have different fundamental frequencies over time. Speech can have energy across a wide range of frequencies. The spectra of non-stationary noise can be similar to speech. Therefore, in a speech denoising application, where one "source" is speech and the other "source" is additive noise, the overlap between speech and noise models degrades the performance of the denoising.

Model-based speech enhancement methods, which rely on separately modeling the speech and the noise, have been shown to be powerful in many different problem settings. When the structure of the noise can be arbitrary, which is often the case in practice, model-based methods have to focus on developing good speech models, whose quality is a key to their performance.

In terms of modeling strategy, two broad approaches exist. One approach is based on discrete state modeling such as Gaussian mixture models. Another approach uses continuously-weighted combinations of basis functions, such as non-negative matrix factorizations and their extensions. The general trade-off is that discrete-state approaches can be more precise, especially in their temporal dynamics, whereas continuous approaches can be more flexible with respect to gain and subspace variability.

For example, U.S. Pat. No. 8,015,003 describes denoising a mixed signal, e.g., speech and noise signals, using a model that includes training basis matrices of a training acoustic signal and a training noise signal, and statistics of weights of the training basis matrices. In general, however, conventional methods that focus on slow-changing noise are inadequate for fast-changing nonstationary noise, such as experienced by using a microphone in a noisy environment. In addition, compensation for fast-changing additive noise requires high computational power to the degree that methods than can compensate for all possible multitude of noise and speech variations may quickly become computationally prohibitive.

Therefore, it is desired to provide a dynamic and adaptive speech enhancement method.

SUMMARY OF THE INVENTION

Some embodiments of the invention use a probabilistic model for enhancing a noisy speech signal. One object of some embodiments is to model the speech precisely by taking into account the underlying speech production process as well as its dynamics. According to various embodiments of the invention, the probabilistic model is a non-negative source-filter dynamical system (NSFDS) having the excitation and filter parts modeled as a non-negative dynamical system.

For example, the state of the model can be factorized into discrete components for the filter, i.e., phoneme, states and the excitation states which allow the simplification of the training and denoising parts of the speech enhancing method. In addition, the NSFDS constraints the corresponding states of the excitation and the filter components to be statistically dependent over time forming a Markov chain. These constraints can represent dynamics of the speech, leading to a hybrid between a factorial HMM, and the non-negative dynamical system approach.

Also, in some embodiments, the NSFDS models the excitation and the filter components as non-negative dynamical systems, such that the hidden variables representing the excitation and the filter components are determined as a non-negative linear combination of non-negative basis functions. For example, modeling the power spectrum using a non-negative linear combination of non-negative basis functions solves the problem of adapting to gain and other variations in the signals being modeled. Different embodiments have separately added either dynamical constraints, e.g., in form of statistical dependence over time, or excitation-filter factorization constraints, or combination thereof.

Overall, the dynamical constraints address inaccuracies stemming from unrealistic transitions in the inferred signal over time, and the excitation-filter constraints address inaccuracies due to insufficient training data because they represent excitation and filter characteristics separately instead of modeling all combinations. Extending the modeling of the power spectrum using a non-negative linear combination of non-negative basis functions using a combination of dynamical constraints and excitation-filter constraints allows bringing together the advantages of adding dynamical constraints and excitation-filter constraints, while keeping the computational cost of the enhancement of the speech suitable for real time applications.

In addition, using separate dynamics on the excitation components and the filter components brings the additional benefit of a more accurate and efficient modeling, because the excitation and filter characteristics of speech are governed by separately evolving physical processes in the mouth and the throat of the speaker.

Accordingly, one embodiment discloses a method for enhancing an input noisy signal, wherein the input noisy signal is a mixture of a clean speech signal and a noise signal. The method includes determining from the input, noisy signal, using a model of the clean speech signal and a model of the noise signal, sequences of hidden variables including at least one sequence of hidden variables representing an excitation component of the clean speech signal, at least one sequence of hidden variables representing a filter component of the clean speech signal, and at least one sequence of hidden variables representing the noise signal, wherein the model of the clean speech signal includes a non-negative source-filter dynamical system (NSFDS) constraining the hidden variables representing the excitation component to be statistically dependent over time and constraining the hidden variables representing the filter component to be statistically dependent over time, and wherein the sequences of hidden variables include hidden variables determined as a non-negative linear combination of non-negative basis functions; and generating an output signal using a product of corresponding hidden variables representing the excitation and the filter components. The steps of the method are performed by a processor.

Another embodiment discloses a system for enhancing an input noisy signal, wherein the input noisy signal is a mixture of a clean speech signal and a noise signal. The system includes a memory for storing a model of the clean speech signal, wherein the model of the clean speech signal includes a non-negative source-filter dynamical system (NSFDS); and a processor for determining, from the input noisy signal using the NSFDS, sequences of hidden variables including at least one sequence of hidden variables representing an excitation component of the clean speech signal, at least one sequence of hidden variables representing a filter component of the clean speech signal, wherein the NSFDS constraints the hidden variables representing the excitation and the filter components to be statistically dependent over time, and wherein the sequences of hidden variables include hidden variables determined as a non-negative linear combination of non-negative basis functions, and for generating an output signal using a product of corresponding hidden variables representing the excitation and the filter components.

BRIEF DESCRIPTION OF THE DRAWINGS

FIG. 6 is a table showing update rules for variables of clean speech.

DETAILED DESCRIPTION OF THE PREFERRED EMBODIMENT

Figure 1A:
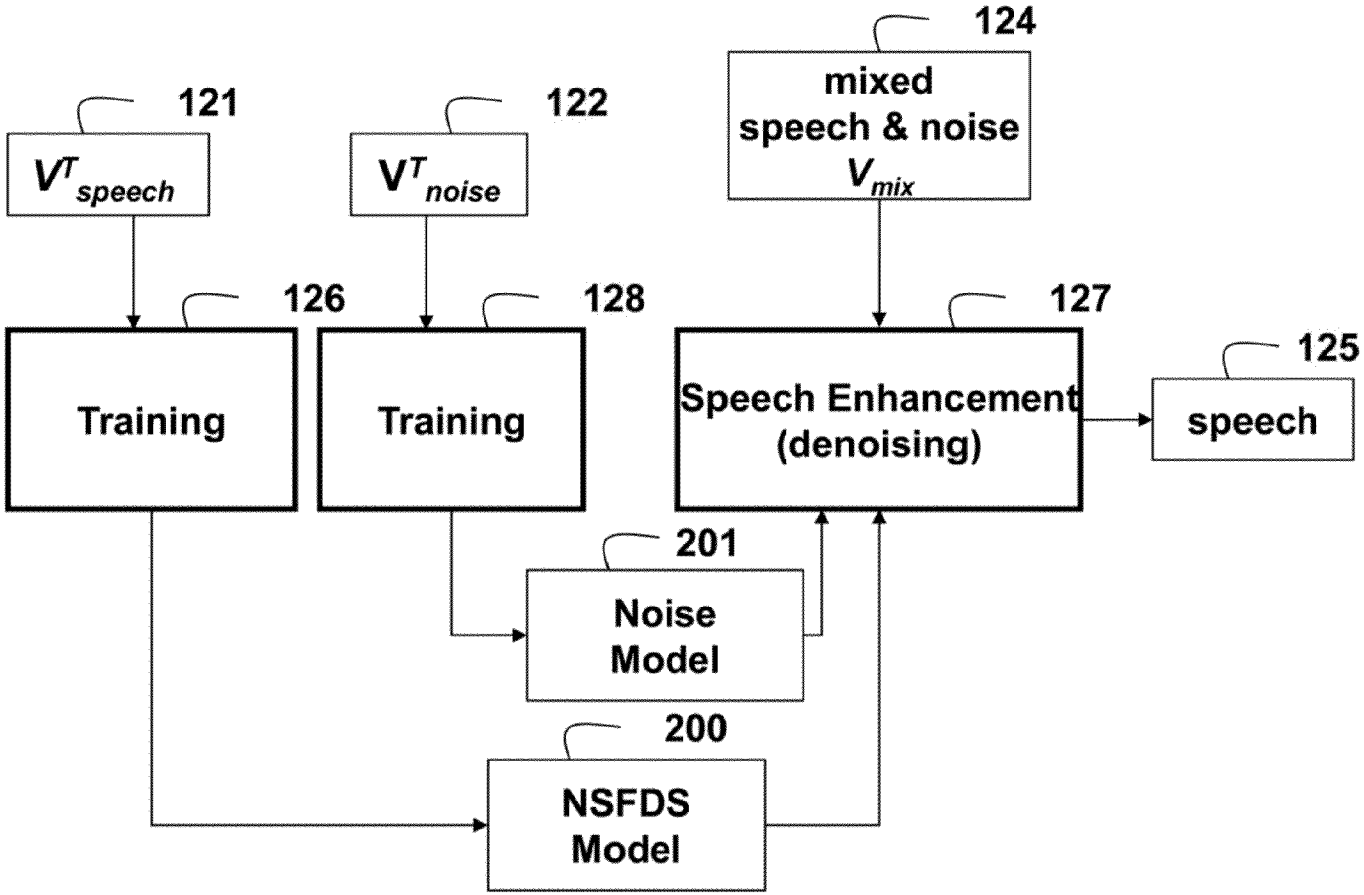
FIG. 1A is a general block diagram of a method for denoising mixture of speech and noise signals according to some embodiments of the invention.

FIG. 1A shows a general block diagram of a method for denoising a mixture of speech and noise signals according to some embodiments of the invention. The method includes one-time speech model training 126 and one-time noise model training 128 and a real-time denoising 127 parts.

Input to the one-time speech model training 126 includes a training acoustic signal ($V^T_{speech}$) 121 and input to the one-time noise model training 128 includes a training noise signal ($V^T_{noise}$) 122. The training signals are representative of the type of signals to be denoised, e.g., speech and non-stationary noise. Output of the training is a model 200 of the clean speech signal and a model 201 of the noise signal. In various embodiments of the invention, the model 200 is a non-negative source-filter dynamical system (NSFDS), described in more details below. The model can be stored in a memory for later use.

Input to the real-time denoising 127 includes a model 200 of the clean speech, a model 201 of the noise and an input signal ($V_{mix}$) 124, which is a mixture of the clean speech and the noise. The output signal of the denoising is an estimate of the acoustic (speech) portion 125 of the mixed input signal.

After the NSFDS model 200 is trained, the model can be used in a speech enhancement application and/or as part of speech processing application, e.g., for recognizing speech in a noisy environment, such as in cars where the speech is observed under non-stationary car noises. The method can be performed in a processor operatively connected to memory and input/output interfaces.

Figure 1B:
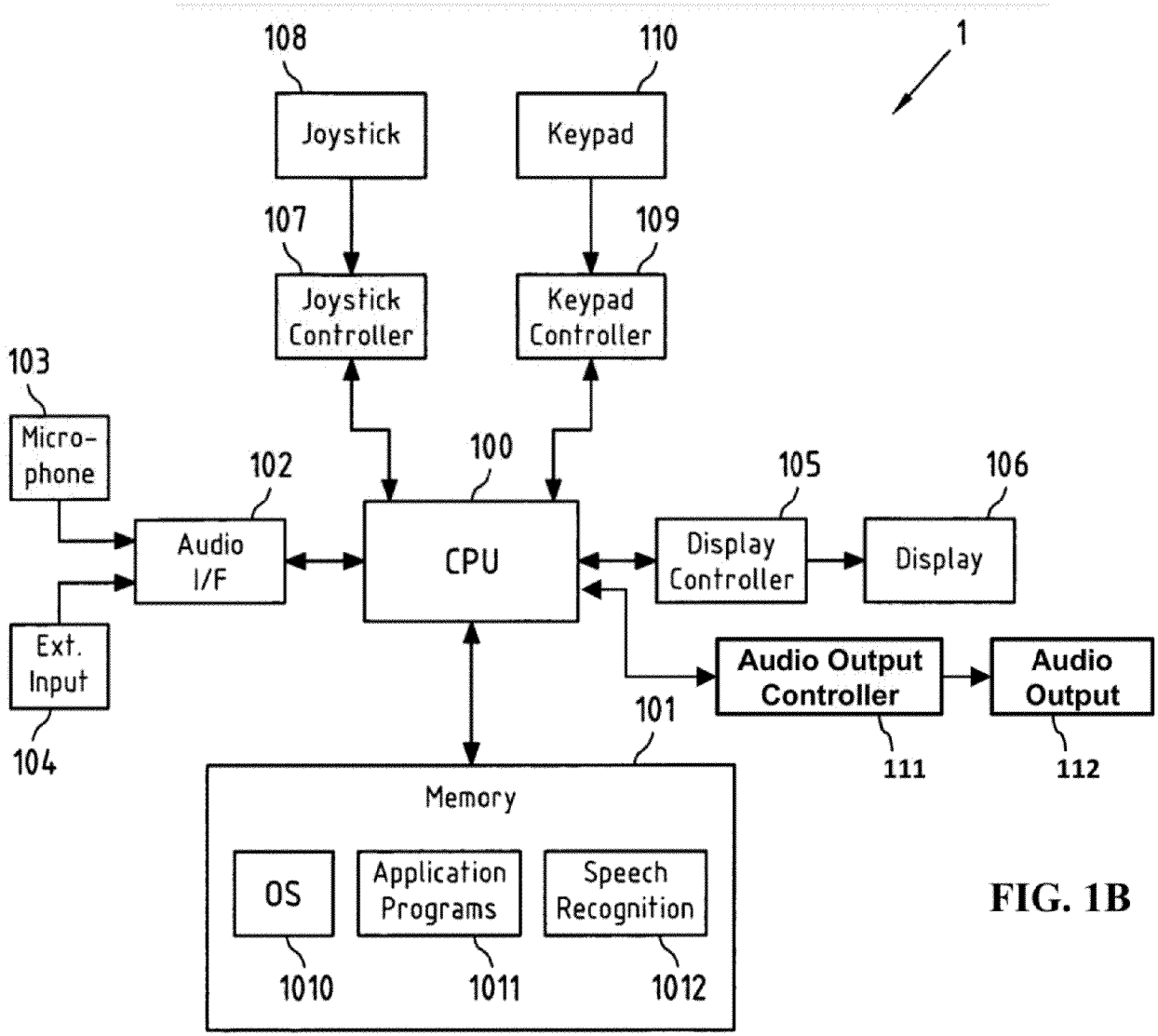
FIG. 1B is an example of a system for denoising the speech mixed with noise according to some embodiments of the invention.

FIG. 1B shows an example of a system 1 capable of denoising the speech signal mixed with noise according to some embodiments of the invention. The system 1 includes a central processing unit (CPU) 100, which controls the operation of the entire or parts of the system. The system 1 interacts with a memory 101, which includes, software related to an operating system (OS) 1010 of the system, application programs 1011 that can be executed by the CPU 100 to provide specific functionalities to a user of the system, such as dictation and error correction, and software 1012 related to speech recognition. The NSFDS model 200 can also be stored in the memory 101.

The system 1 can also include an audio interface (I/F) 102 to receive speech, which can be acquired by microphone 103 or received from external input 104, such as speech acquired from external systems. The system 1 can further include one or several controllers, such as a display controller 105 for controlling the operation of a display 106, which may for instance be a liquid crystal display (LCD) or other type of the displays. The display 106 serves as an optical user interface of system 1 and allows for example to present sequences of words to a user of the system 1. The system 1 can further be connected to an audio output controller 111 for controlling the operation of an audio output system 112, e.g., one or more speakers. The system 1 can further be connected to one or more input interfaces, such as a joystick controller 107 for receiving input from a joystick 108, and a keypad controller 109 for receiving input from a keypad 110. It is readily understood that the use of the joystick and/or keypad is of exemplary nature only. Equally well, a track ball, or arrow keys may be used to implement: the required functionality. In addition, the display 106 can be a touchscreen display serving as an interface for receiving the inputs from the user. Furthermore, due to the ability to perform speech recognition, the system 1 may completely dispense with any non-speech related interfaces altogether. The audio I/F 102, joystick controller 107, keypad controller 109 and display controller 105 are controlled by CPU 100 according to the OS 1010 and/or the application program 1011 CPU 100 is currently executing.

Figure 1C:
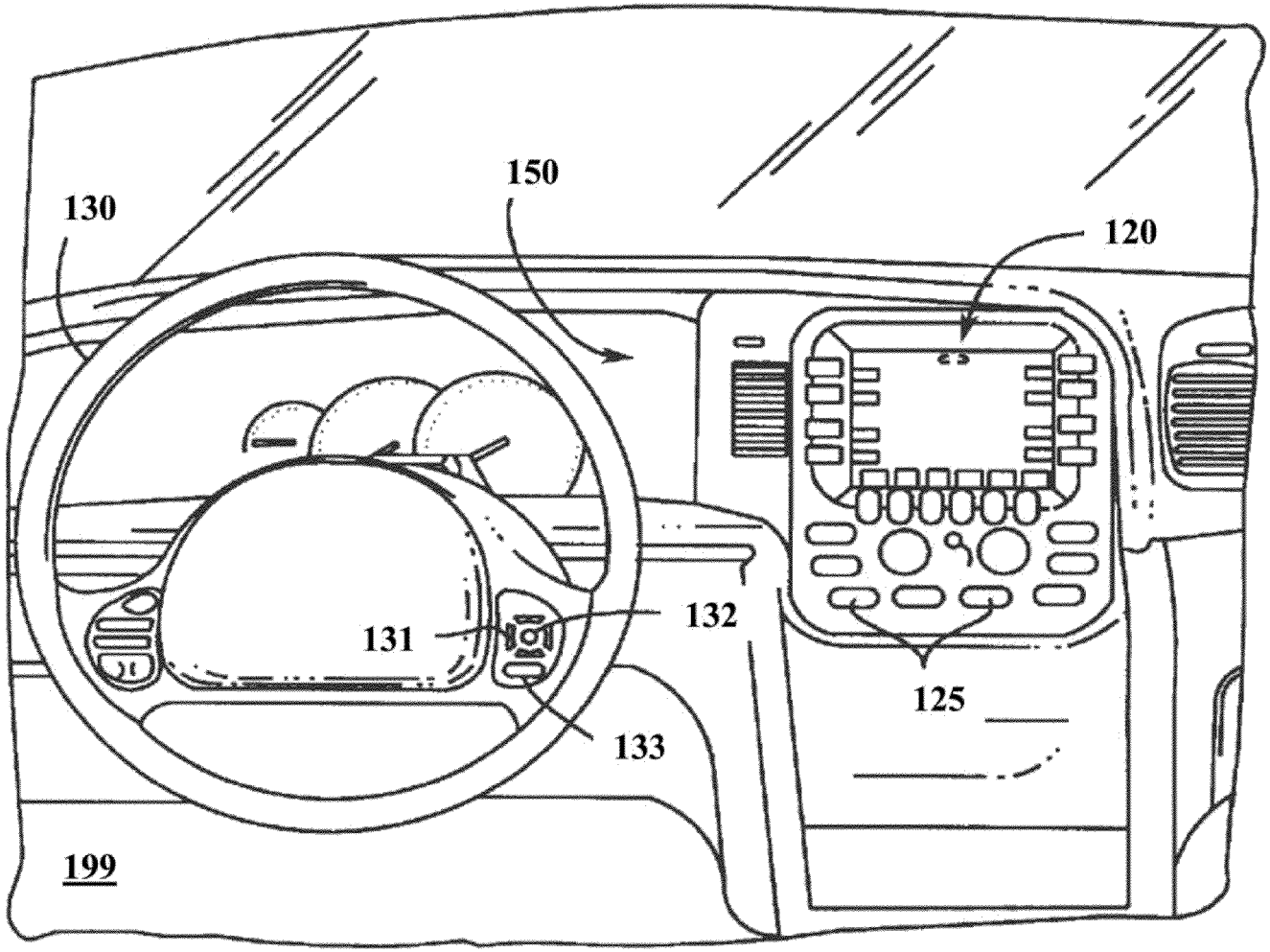
FIG. 1C is a schematic an example of an instrumental panel including the system of FIG. 1B according to some embodiments of the invention.

As shown in FIG. 1C, the system 1 can be embedded in an instrumental panel 150 of a vehicle 199. Various controls 131-133 for controlling an operation of the system 1 can be arranged on a steering wheel 130. Alternatively or additionally, the controls 125 can be place on a control module 120. The system 1 can be configured to improve the interpretation of speech in a noisy environment of operating the vehicle.

Non-Negative Source-Filter Dynamical System

Figure 2:
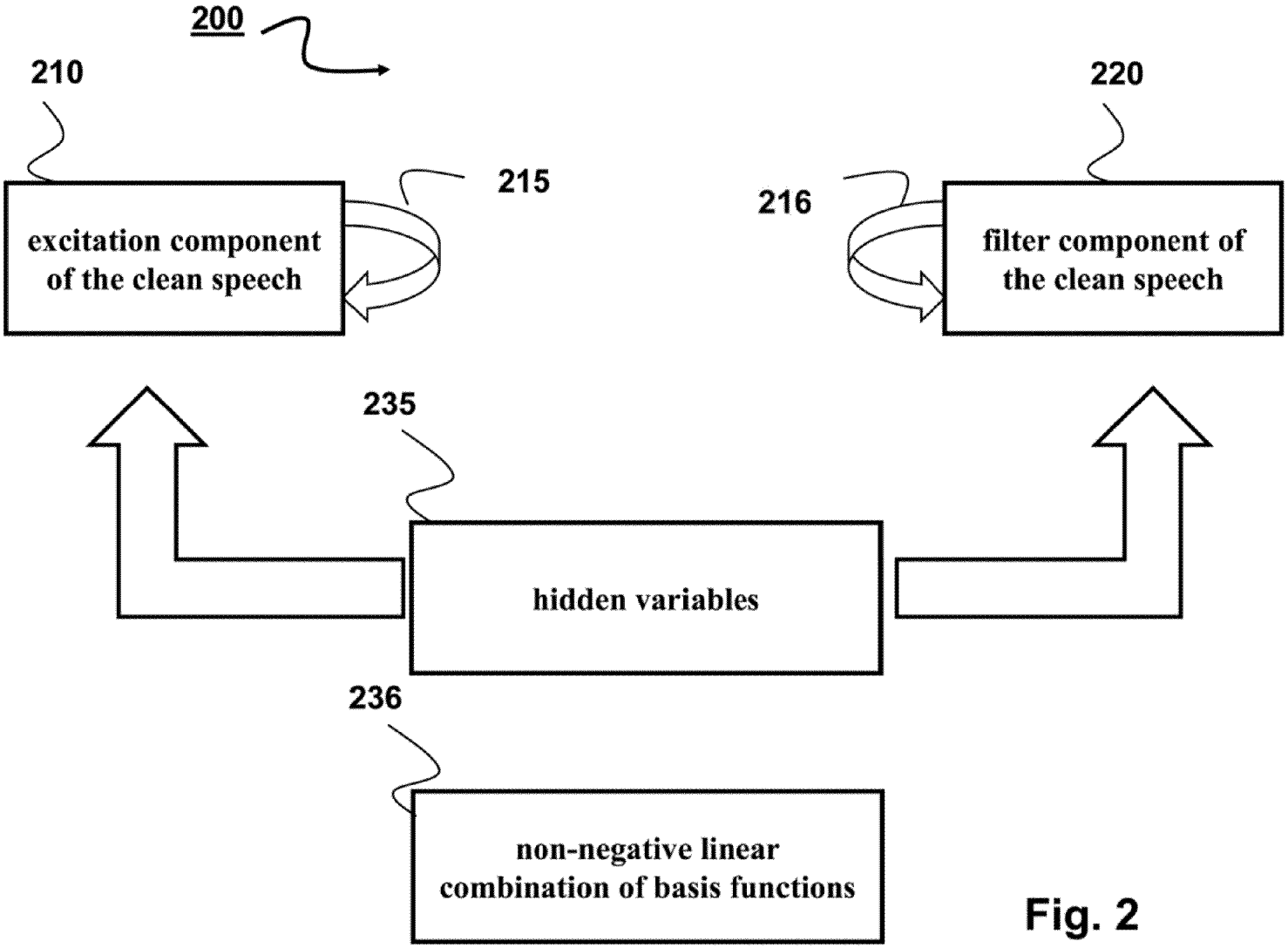
FIG. 2 is a schematic of the non-negative source-filter dynamical system (NSFDS) according to some embodiments of the invention.

FIG. 2 shows a schematic of the non-negative source-filter dynamical system (NSFDS) according to some embodiments of the invention. The NSFDS follows the source-filter models that represent the excitation source and the filtering of the vocal tract as separate factors. Specifically, the NSFDS models speech as a combination of a sound source, such as the vocal cords, and an acoustic filter of the vocal tract and radiation characteristic.

Accordingly, the NSFDS 200 includes excitation component 210 of the clean speech corresponding to the excitation part of the signal, which is mainly formed by vocal cord vibrations (voicing) having a particular pitch, turbulent air noise (fricatives), and air flow onset/offset sounds (stops), and their combinations. The NSFDS 200 also includes filter component 220 of the clean speech corresponding to the influence of the vocal tract on the spectral envelope of the sound, as in the case of different vowels ('ah' versus 'ee') or differently modulated fricative modes ('s' versus 'sh').

In some embodiments the excitation and the filter components are represented by corresponding hidden variables 235, which are referred as hidden, because those hidden variables are not measured from a mixed noisy speech but estimated, as described below. The approximation of the speech using the source-filter approach allows simplifying the training of the model and estimation of the hidden variables.

The NSFDS model 200 constraints the corresponding hidden variables representing the excitation and the filter components to be statistically dependent over time. For example, the NSFDS constrains 215 the hidden variables representing the excitation component to be statistically dependent over time and also constrains 216 the hidden variables representing the filter component to be statistically dependent over time. In some embodiments, the dependence 215 and/or 216 is formed as a Markov chain. These constraints allow representing dynamics of the speech, leading to a hybrid between a factorial HMM and the non-negative dynamical system approach.

In addition, the NSFDS models the excitation and/or the filter components using a non-negative linear combination of non-negative basis functions, i.e., the sequences of hidden variables 235 include hidden variables 236 determined as a non-negative linear combination of non-negative basis functions. Modeling, e.g., the power spectrum of the speech, using a non-negative linear combination of non-negative basis functions solves the problem of adapting to volume and other variations in the signals being modeled. Different embodiments have separately added either dynamical constraints, e.g., in form of statistical dependence over time, or excitation-filter factorization constraints, or combination thereof.

Overall, the dynamical constraints address inaccuracies stemming from unrealistic transitions in the inferred signal over time, and the excitation-filter constraints address inaccuracies due to insufficient training data because they represent excitation and filter characteristics separately instead of modeling all combinations. Extending the modeling of the power spectrum using a non-negative linear combination of non-negative basis functions using a combination of dynamical constraints and excitation-filter constraints allows bringing together the advantages of adding dynamical constraints and those of adding excitation-filter constraints.

In addition, using separate dynamics on the excitation components and the filter components brings the additional benefit of a more accurate and efficient modeling, because the excitation and filter characteristics of speech are governed by separately evolving physical processes in the mouth and throat of the speaker.

Figure 3A:
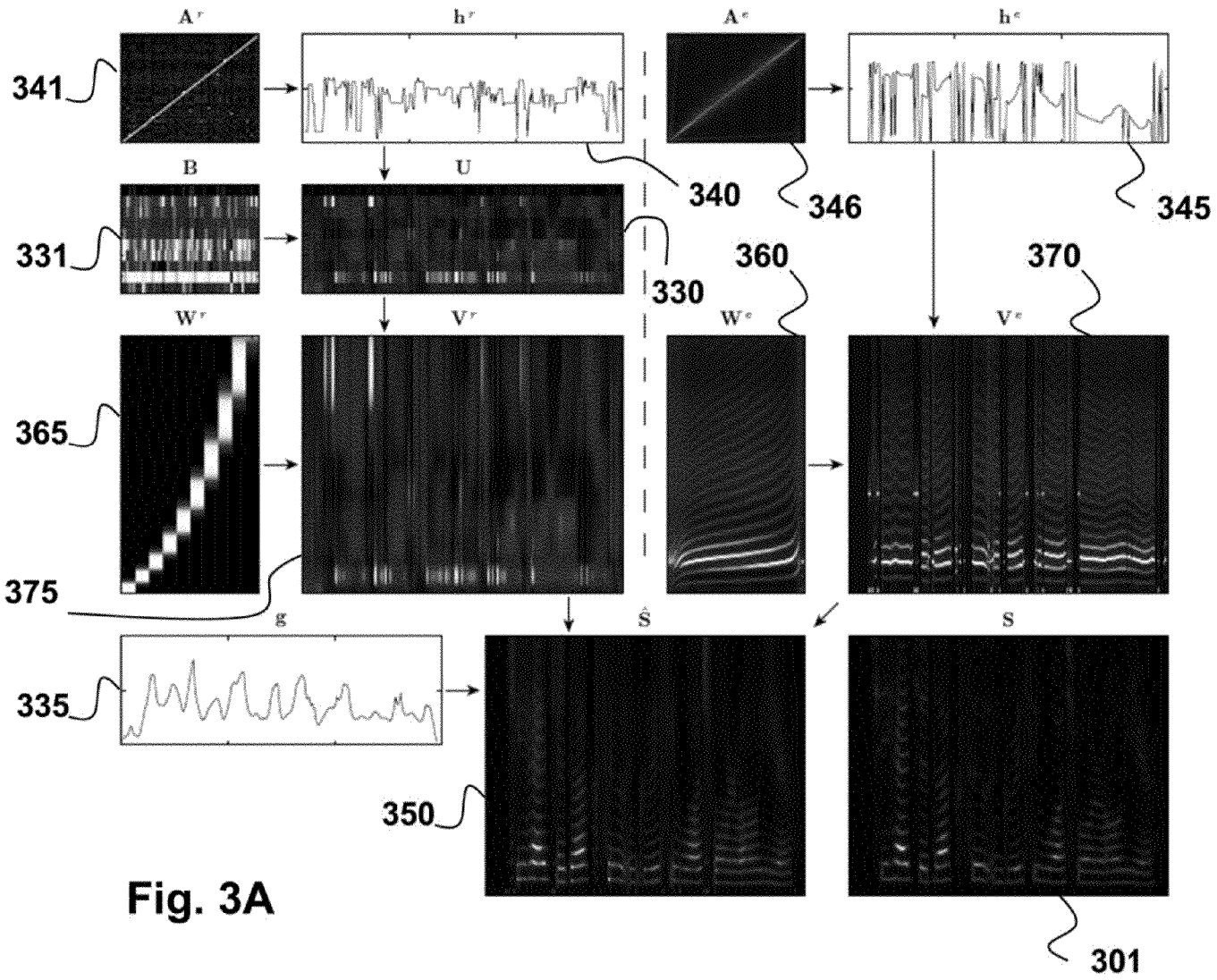
FIG. 3A is an illustration of empirical values of components of the NSFDS according to some embodiments of the invention.

FIG. 3A shows an illustration of empirical values of components of the NSFDS. The arrows on the block diagram show the relationship among the components. The object of this model is to estimate 350 the clean speech 301 present in the mixed noisy speech signal.

Figure 3B:
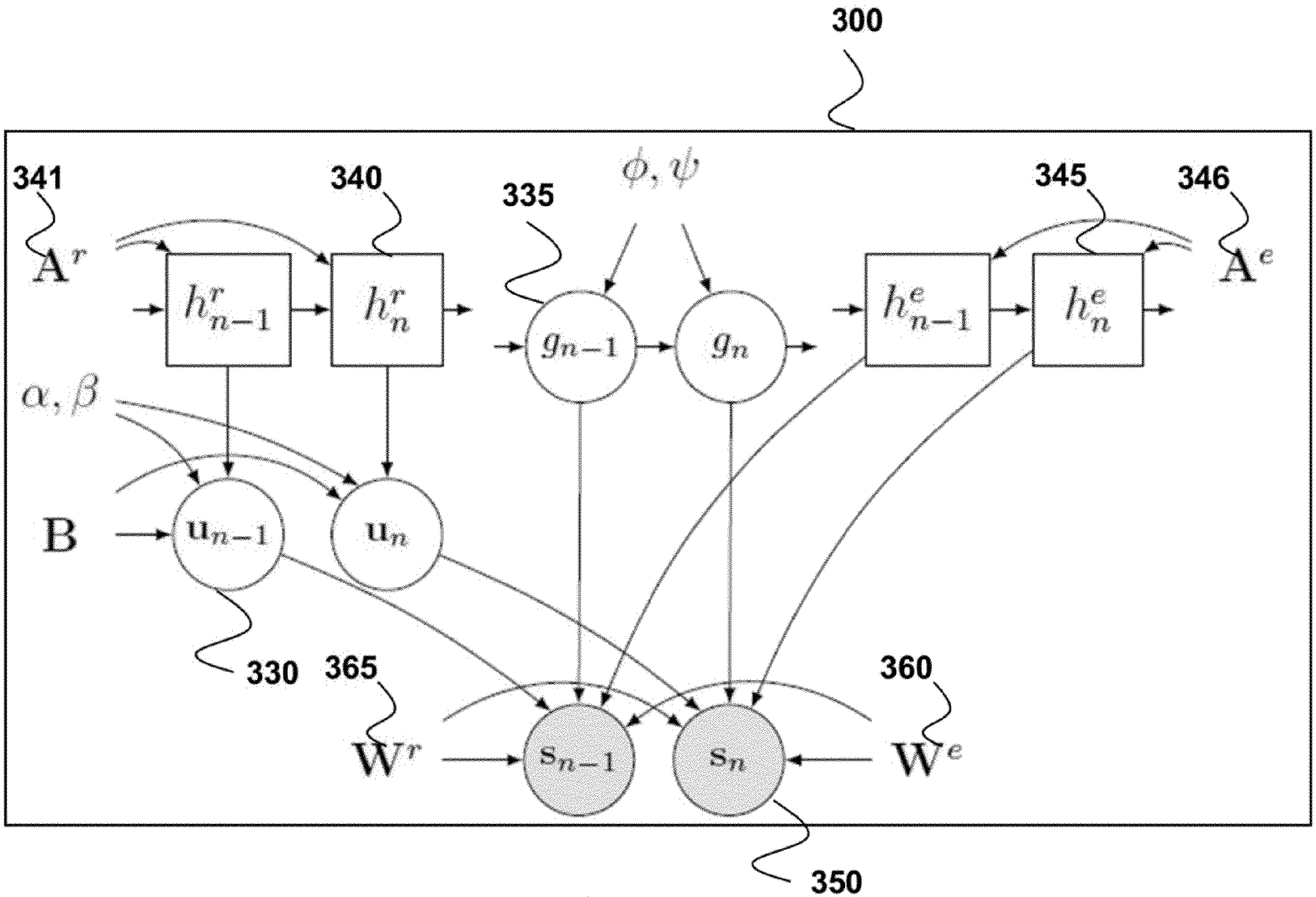
FIG. 3B is a graph of the NSFDS model of the speech. according to some embodiments of the invention.

FIG. 3B shows a graph 300 of the NSFDS model 200 according to some embodiments of the invention. In the graph 300, the circular nodes, such as nodes 330 and 335 denote the continuous random variables, the rectangular nodes, such as nodes 340 and 345, denote the discrete random variables, and shaded nodes, such as the node 350, denote the observed variables. The arrows determine the conditional independence structure.

The NSFDS model in the complex spectrum $X \in \mathbb{C}^{F \times N}$ can be described as a conditionally zero-mean complex Gaussian distribution, $$x_{fn} \approx N_c(x_{fn}; 0, g_n v_{fn}^T v_{fn}^e), \tag{1}$$

whose variance is modeled as the product of a filter component 375 $v_{fn}^r$, an excitation component 370 $v_{fn}^e$, and a gain 355 $g_n$, where f denotes the frequency index and n the frame index. The filter component aims to capture the time-varying structure of the phonemes, whereas the excitation component aims to capture time-varying pitch and other excitation modes of the speech. The gain component helps the model to track changes in amplitude of the speech signal.

This modeling approach is equivalent to assuming an exponential distribution over the power spectrum $s_{fn}=|x_{fn}|^2$, with $s_{fn} \sim E(s_{fn}; 1/(g_n v_{fn}^r v_{fn}^e))$. Maximum likelihood estimation on this model is equivalent to minimizing the Itakura-Saito divergence between $s_{fn}$ and $g_n v_{fn}^r v_{fn}^e$.

For a given time frame n, the excitation component $v_n^e$ is assumed to be a column of an excitation dictionary 360 $W^e \in \mathbb{R}_+^{F \times K_e}$:

$$v_{fn}^e = \Pi_m w_{fm}^{e[h_n^e = m]}, \tag{2}$$

where [·] is the indicator function, i.e., [x]=1 if x is true and 0 otherwise.

Here, the discrete random variable $h_n^e \in \{1, \ldots, K_e\}$ 345 is referred as "excitation label" and determines the pitch and other excitation modes.

The NSFDS models the filter component 375 $V^r$ as the multiplication of a filter dictionary 365 $W^r \in \mathbb{R}_+^{F \times K_r}$ and an activation matrix 330 $U \in \mathbb{R}_+^{K_r \times N}$, where the domain of U is restricted in such a way that each column of U is a noisy realization of a column of an activation dictionary 331 $B \in \mathbb{R}_+^{K_r \times I_r}$.

$$v_{fn}^r = \Sigma_k w_{fk}^r u_{kn},$$

$$u_{kn}(\Pi_i b_{ki}^{[h_n^r = i]}) \epsilon_{kn}^u \sim G(\epsilon_{kn}^u; \alpha, \beta). \tag{3}$$

In Equation (3) the filter dictionary $W^r$ is represented by its basis functions $v_{fn}^r = \Sigma_k w_{fk}^r u_{kn}$, and at least some hidden variables of the filter component are determined as a non-negative linear combination of non-negative basis functions. In some alternative embodiments, the hidden variables of the excitation component are determined as a non-negative linear combination of non-negative basis functions in addition or instead of the hidden variable of the excitation component.

The variable 340 $h_n^r \in \{1, \ldots, I_r\}$ are referred herein as a "phoneme label" and $h_n^r$ determines the column 331 of B that is selected at time frame n. The gamma distribution G is defined using shape and inverse scale parameters.

In one embodiment, in order to introduce continuous dynamics and enforce smoothness, the NSFDS uses a gamma Markov chain on the gain variables 335 g:

$$g_n = (g_{n-1}) \epsilon_n^g, \ \epsilon_n^g \sim G(\epsilon_n^g; \phi, \psi). \tag{4}$$

One embodiment, to simplify the computations, constrains the innovations $\epsilon$ to have mean 1 by taking $\alpha=\beta$, $\phi=\psi$. In addition, some embodiments assume Markovian prior probabilities on the phoneme labels $h^r$ and the excitation labels $h^e$ in order to incorporate contextual information, with transition matrices 341 $A^r$ and 346 $A^e$:

$$h_n^r|h_{n-1}^r \sim \Pi_i \Pi_j a_{ij}^{r[h_n^r=i][h_{n-1}^r=j]},$$

$$h_n^e|h_{n-1}^e \sim \Pi_i \Pi_j a_{ij}^{e[h_n^e=i][h_{n-1}^e=j]}, \quad (5)$$

In some variations of the embodiments, the filter and the excitation Markov chains are also made interdependent to better model their statistical relationships. In alternative embodiments the filter and the excitation Markov chains are marginally independent, because such dependency increases the complexity of the model.

Hence, in one embodiment, the NSFDS model is determined based on a combination of the equations (1)-(5). The power spectrum S is decomposed as a product of a filter part $V^r$, an excitation part $V^e$, and gains g. The smooth overlapping filter dictionary $W^r$ implicitly restricts $V^r$ to capture the smooth envelope of the spectrum. The dictionary $W^e$ captures the spectral shapes of the excitation modes. $\hat{S}$ is the model prediction of an output signal determined using a product of corresponding hidden variables representing the excitation and the filter components, e.g., determined according to $$\hat{S}_{fn}=g_n v_{fn}^r v_{fn}^e.$$

Figure 4:
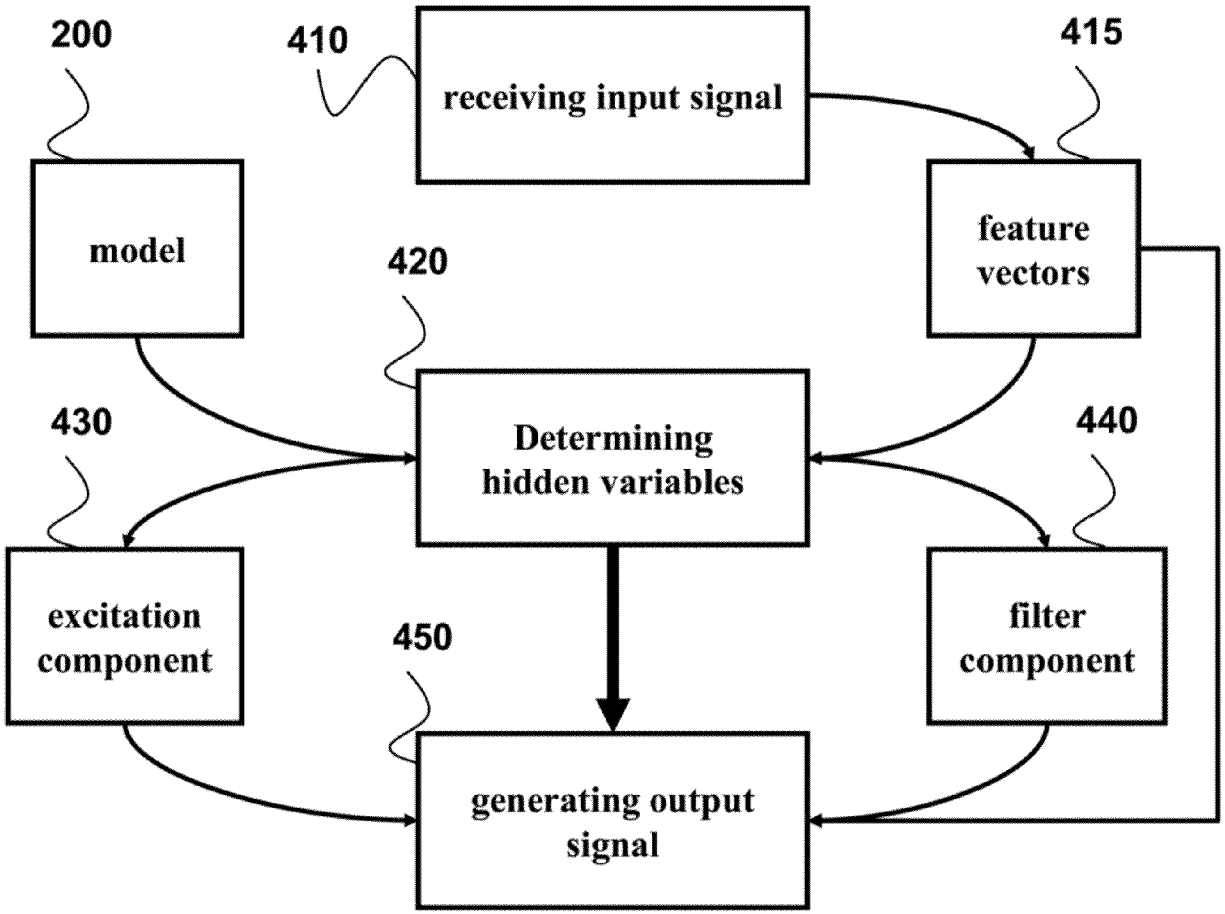
FIG. 4 is a block diagram of a method for enhancing a noisy speech signal according to one embodiment of the invention.

FIG. 4 shows a block diagram of a method for enhancing a noisy speech signal according to one embodiment of the invention. The steps of the method are performed by a processor, e.g., by the CPU 100. The method receives 410 an input signal as a mixture of a clean speech and a noise. For example, the input signal can be represented as a sequence of the feature vectors 415. For the input signal, the method determines 420, using a model 200 of the noisy speech signal, sequences of hidden variables including at least one sequence 430 of hidden variables representing an excitation component of the clean speech, at least one sequence 440 of hidden variables representing a filter component of the clean speech. In some embodiments, the method also determines at least one sequence of hidden variables representing the noise. Next, the method generates 450 an output signal using a product of corresponding hidden variables representing the excitation and the filter components.

The model 200 of the noisy speech signal is a non-negative source-filter dynamical system (NSFDS) constraining the corresponding hidden variables representing the excitation and the filter components to be statistically dependent over time. The statistical dependence can be enforced using a Markov chain. For example, the Markov chain can be discrete or continuous. The NSFDS models the excitation and the filter components using a non-negative linear combination of non-negative basis functions.

Example of Speech Denoising with the Probabilistic Model

Figure 5:
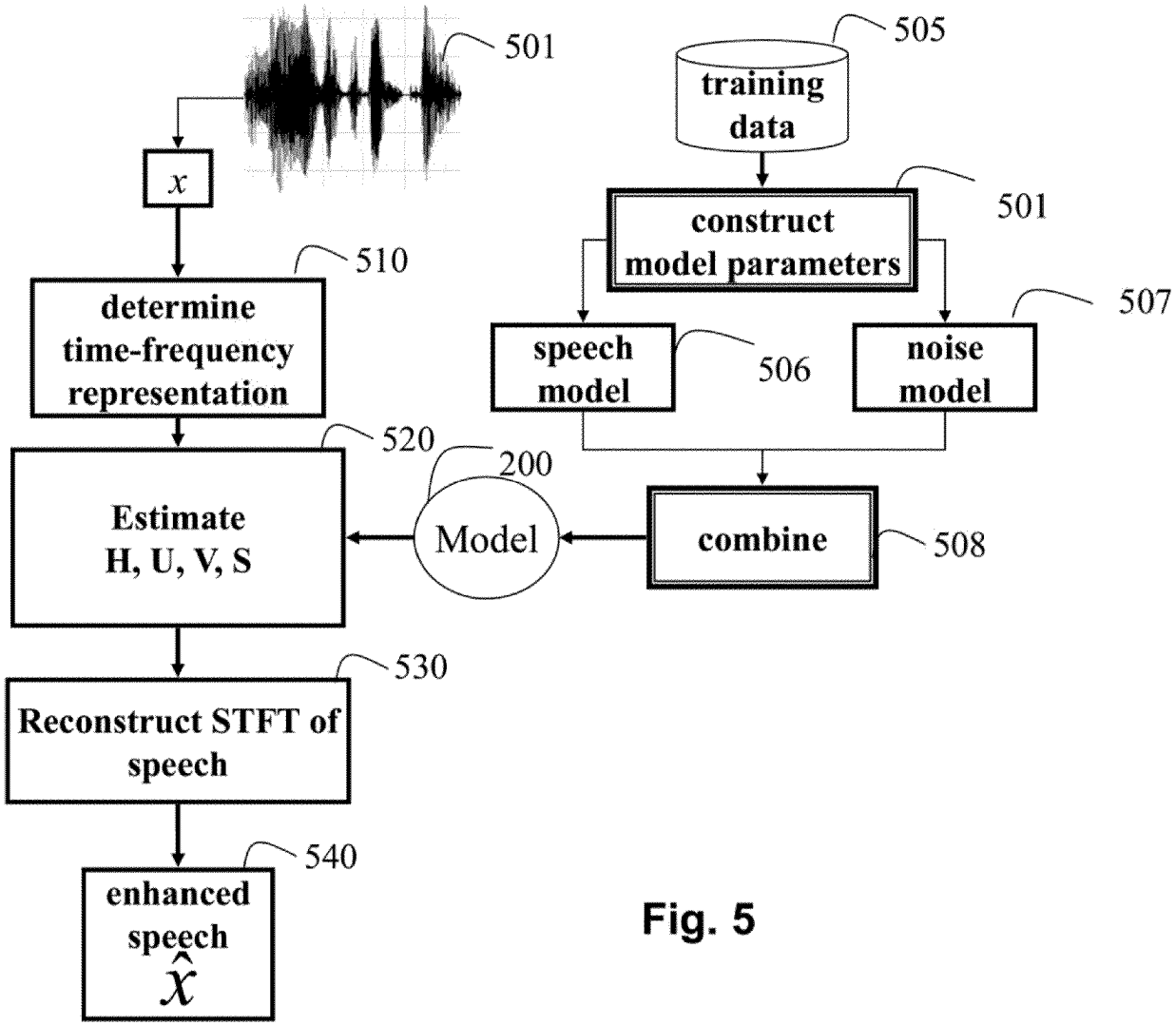
FIG. 5 is a block diagram of an exemplar method employing principles of some embodiments.

FIG. 5 shows a block diagram of an exemplar method employing principles of some embodiments. The method constructs the model parameters 501 for speech 506 by estimating; bases W and the transition matrix A on some speech (audio) training data 505 for the excitation and the filter components, as described above.

Similarly, the method constructs a noise model 307 with bases $W^{(n)}$ and transition matrix $A^{(n)}$, and combines the two models 306-307. The model 200 is used to enhance an input audio signal x 501. The method determines 510 a time-frequency feature representation, and determines 520 estimations of hidden variables of the excitation and the filter components that vary, i.e., labels h, the activation matrix U, the excitation and the filter components V, and the estimation of the enhanced speech S.

Thus, we obtain a single model that combines speech and noise, which is then used to reconstruct 530 a complex-valued short-time Fourier transform (STFT) matrix X of the enhanced speech $\hat{x}$ 540. The time-domain signal can be reconstructed using an overlap-add method, which evaluates a discrete convolution of a very long input signal with a finite impulse response filter. For example, one embodiment reconstructs the time-domain speech estimate by taking the inverse STFT of the enhanced speech $\hat{x}$.

Some embodiments use convergence-guaranteed update rules for maximum a-posteriori (MAP) estimation in the NSFDS model. For example, one embodiment uses the majorization-minimization (MM) method that monotonically decreases the intractable MAP objective function by minimizing a tractable upper-bound constructed at each iteration. This method is a block-coordinate descent method, which performs alternating updates of each latent factor given its current value and the other factors. The MM method yields the following updates for B and $W^e$:

$$b_{ki} \leftarrow \frac{\beta \Sigma_n [h_n^r = i] u_{kn}}{\alpha \Sigma_n [h_n^r = i]}, \quad w_{fm}^e \leftarrow \frac{\Sigma_n [h_n^r = m] \frac{s_{fn}}{g_n v_f^r n}}{\Sigma_n [h_n^e = m]} \quad (6)$$

FIG. 6 shows update rules for variables U and g for clean speech. The updates of U and g involve finding roots of second order polynomials. Each variable of a column 650 can be updated at each iteration to $$\frac{\sqrt{b^2 - 4ac} - b}{2a}$$

with different values 620, 630 and 640 of parameters a, b, and c for each variable. The corresponding equations are given in Table 610.

Given all other variables, the optimal values of $h^r$ and $h^e$ can be determined via, e.g., Viterbi algorithm at each iteration. The transition matrices $A^r$ and $A^e$ are estimated from the transition counts in the training data.

Noisy Speech Model

Some embodiments consider a mixture of speech with additive noise, which leads to a linear relationship in the complex spectrum domain, $x_{fn}^{mix}=x_{fn}^{speech}+x_{fn}^{noise}$. This relationship avoids assuming additivity of the power spectra, an approximation made by many other methods, if the speech and the noise are both modeled with conditionally zero-mean complex Gaussian distributions:

$$x_{fn}^{speech} \sim N_c(x_{fn}^{speech}; 0, v_{fn}^{speech}), \; x_{fn}^{noise} \sim N_c(x_{fn}^{noise}; 0, v_{fn}^{noise}). \quad (7)$$

Here, $x_{fn}^{speech}$ is modeled by NSFDS, i.e., $v_{fn}^{speech}=g_n v_{fn}^r v_{fn}^e$ as defined in Eqs. 2-4. For the noise, some embodiments use smooth NMF (SNMF) method:

$$h_{kn}^{noise}=h_{k(n-1)}^{noise}\epsilon_{kn}^h, \epsilon_{kn}^h \sim G(\epsilon_{kn}^h; \alpha^{noise}, \beta^{noise}),$$

$$v_{fn}^{noise}=\Sigma_k w_{fk}^{noise} h_{kn}^{noise}, \quad (8)$$

where $v_{fn}^{noise}$ is assumed to be the product of a spectral dictionary $W^{noise}$ and its corresponding activations $H^{noise}$. SNMF is an extension of NMF that imposes a gamma Markov chain on the activations in order to enforce smoothness. Here, we set $\alpha^{noise}=\beta^{noise}$ to constrain the innovations $\epsilon_{kn}^{h}$ to have mean 1.

Some embodiments estimate the variables $h^r$, $h^e$, U, g, $W^{noise}$, and $H^{noise}$. After these variables are estimated, the MAP estimate, and equivalently the minimum mean squares estimate (MMSE), of the complex clean speech spectrum $\hat{x}_{fn}^{speech}$ is given by Wiener filtering:

$$\hat{x}_{fn}^{speech} = \frac{v_{fn}^{speech}}{v_{fn}^{speech} + v_{fn}^{noise}} x_{fn}^{mix}. \tag{9}$$

Some embodiments reconstruct the time-domain speech estimate by taking the inverse STFT of $\hat{X}^{speech}$.

Training Procedure

During training, the exemplar embodiments make use of reference information for the filter labels $h^r$ and excitation labels $h^e$, and keep those labels fixed to their reference values throughout the training process. For the filter labels $h^r$, exemplar embodiments use as reference labels the phoneme annotations provided with a speech database. For the excitation labels $h^e$, the exemplar embodiments allocate an excitation state to each unvoiced phoneme, and estimate the remaining (voiced) states by running a pitch estimator on the speech training data and quantizing the obtained pitch estimates with the k-means algorithm.

To enforce a smooth filter component $V^r$, some exemplar embodiments use as elementary filters $W^r$ overlapping sine-shaped bandpass filters, uniformly distributed on the Mel-frequency scale. The number of elementary filters $K^r$ should be small in order to prevent the filter part from capturing the excitation part. By using smooth overlapping filters for $W^r$, the filter part $V^r$ is restricted to capture the smooth envelope of the spectrum.

To initialize $W^e$, the exemplar embodiments first compute the cepstrum C=DCT{ log S}, where DCT stands for the discrete cosine transform and S is the power spectrum of the training data. Eliminating the lower part of the cepstrum to remove the phoneme-related information, the exemplar embodiments define the high-pass filtered spectrum, $$S^{high}=\exp(IDCT\{C^{high}\}),$$

where $c_{fn}^{high}=c_{fn}$ if $f>f_c$, and 0 otherwise, and $f_c$ is a cut-off frequency. Each column of $W^e$ is initialized as the average of the corresponding columns of the filtered spectrum:

$$w_{fm}^{e}=(\Sigma_n[h_n^e=m]s_{fn}^{high})/(\Sigma_n[h_n^e=m]).$$

The variables U and g are initialized randomly under a uniform distribution. After the variables are initialized, the NSFDS model is trained using, e.g., the update rules described in Equation (6).

The above-described embodiments can be implemented in any of numerous ways. For example, the embodiments may be implemented using hardware, software or a combination thereof. When implemented in software, the software code can be executed on any suitable processor or collection of processors, whether provided in a single computer or distributed among multiple computers. Such processors may be implemented as integrated circuits, with one or more processors in an integrated circuit component. Though, a processor may be implemented using circuitry in any suitable format.

Further, it should be appreciated that a computer may be embodied in any of a number of forms, such as a rack-mounted computer, a desktop computer, a laptop computer, minicomputer, or a tablet computer. Also, a computer may have one or more input and output systems. These systems can be used, among other things, to present a user interface. Such computers may be interconnected by one or more networks in any suitable form, including as a local area network or a wide area network, such as an enterprise network or the Internet. Such networks may be based on any suitable technology and may operate according to any suitable protocol and may include wireless networks, wired networks or fiber optic networks.

Also, the embodiments of the invention may be embodied as a method, of which an example has been provided. The acts performed as part of the method may be ordered in any suitable way. Accordingly, embodiments may be constructed, in which acts are performed in an order different than illustrated, which may include performing some acts simultaneously, even though shown as sequential acts in illustrative embodiments.

Use of ordinal terms such as "first," "second," in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements, Although the invention has been described by way of examples of preferred embodiments, it is to be understood that various other adaptations and modifications can be made within the spirit and scope of the invention. Therefore, it is the object of the appended claims to cover all such variations and modifications as come within the true spirit and scope of the invention.

We claim:

1. A method for enhancing an input noisy signal, wherein the input noisy signal is a mixture of a clean speech signal and a noise signal, comprising:

determining from the input noisy signal, using a model of the clean speech signal and a model of the noise signal, sequences of hidden variables including at least one sequence of hidden variables representing an excitation component of the clean speech signal, at least one sequence of hidden variables representing a filter component of the clean speech signal, and at least one sequence of hidden variables representing the noise signal, wherein the model of the clean speech signal includes a non-negative source-filter dynamical system (NSFDS) constraining the hidden variables representing the excitation component to be statistically dependent over time and constraining the hidden variables representing the filter component to be statistically dependent over time, and wherein the sequences of hidden variables include hidden variables determined as a non-negative linear combination of non-negative basis functions; and generating an output signal using a product of corresponding hidden variables representing the excitation and the filter components, wherein steps of the method are performed by a processor.

2. The method of claim 1, wherein the hidden variables for the excitation component or the filter component include state variables forming a discrete-state Markov chain.

3. The method of claim 1, wherein the hidden variables for the excitation component or the filter component include state variables forming a continuous-state Markov chain.

4. The method of claim 1, wherein the sequences of hidden variables include at least one sequence that represents a gain component, and wherein the output signal is generated as a product of the corresponding hidden variables representing the excitation and the filter components and the gain component.

5. The method of claim 4, wherein the sequence of the gain component forms a Markov chain.

6. The method of claim 4, wherein the sequence of the gain component forms a gamma Markov chain.

7. The method of claim 1, wherein the determining uses a maximum a-posteriori estimation.

8. The method of claim 1, wherein the determining uses a Bayes method.

9. The Method of claim 1, wherein the determining is adaptive and performed on-line on the input noisy signal.

10. The method of claim 1, wherein the hidden variables for the excitation component or the filter component include state variables forming a gamma Markov chain.

11. The method of claim 1, wherein parameters of the model of the noise signal are estimated from a database of training noise signals.

12. The method of claim 1, wherein parameters of the model of the noise signal are estimated from the input noisy signal.

13. The method of claim 1, wherein the model of the noise signal is a non-negative linear combination of non-negative basis functions.

14. The method of claim 1, wherein the model of the noise signal is a non-negative dynamical system.

15. The method of claim 1, wherein the model of the noise signal is a non-negative source-filter dynamical system.

16. The method of claim 1, wherein parameters of the model of clean speech signals are estimated from a database of training clean speech signals.

17. A system for enhancing an input noisy signal, wherein the input noisy signal is a mixture of a clean speech signal and a noise signal, comprising:

a memory for storing a model of the clean speech signal, wherein the model of the clean speech signal includes a non-negative source-filter dynamical system (NSFDS); and a processor for determining, from the input noisy signal using the NSFDS, sequences of bidden variables including at least one sequence of hidden variables representing an excitation component of the clean speech signal, at least one sequence of hidden variables representing a filter component of the clean speech signal, wherein the NSFDS constraints the hidden variables representing the excitation and the filter components to be statistically dependent over time, and wherein the sequences of hidden variables include hidden variables determined as a non-negative linear combination of non-negative basis functions, and for generating an output signal using a product of corresponding hidden variables representing the excitation and the filter components.

* * * * *